US005980162A

United States Patent [19]

McCown

[11] Patent Number: 5,980,162

[45] Date of Patent: Nov. 9, 1999

[54] SEISMIC SHOCK ABSORBING PIER

[76] Inventor: Samps H. McCown, 3360 S. 154th St. E., Wichita, Kans. 67232

[21] Appl. No.: 08/869,857

[22] Filed: Jun. 5, 1997

[51] Int. Cl.[6] ..... E02D 5/74

[52] U.S. Cl. ..... 405/244; 52/167.9; 405/249; 405/251

[58] Field of Search ..... 405/231, 244, 405/249, 251; 52/167.4, 167.9, 169.9

[56] References Cited

U.S. PATENT DOCUMENTS

| | | | |
|---|---|---|---|
| 4,121,393 | 10/1978 | Renault et al. | 52/167 |
| 4,553,792 | 11/1985 | Reeve | 52/167 |
| 4,554,767 | 11/1985 | Ikonomou | 52/167 |
| 4,633,628 | 1/1987 | Mostaghel | 52/167 |
| 5,014,474 | 5/1991 | Fyfe et al. | 52/167 |
| 5,103,605 | 4/1992 | Sul | 52/167 |
| 5,154,539 | 10/1992 | McCown, Sr. et al. | 405/230 |
| 5,456,047 | 10/1995 | Dorka | 52/167.4 |
| 5,492,437 | 2/1996 | Ortiz | 405/231 X |
| 5,722,798 | 3/1998 | Gregory | 405/231 X |
| 5,765,322 | 6/1998 | Kubo et al. | 52/167.7 |
| 5,806,250 | 9/1998 | Medeot et al. | 52/167.4 X |

*Primary Examiner*—Tamara L. Graysay
*Assistant Examiner*—Tara L. Mayo
*Attorney, Agent, or Firm*—Kenneth H. Jack

[57] ABSTRACT

A seismic shock absorbing pier including a cylindrical column having an upper end and a lower end; a slide stop having a load bearing surface, the slide stop being fixedly attached to the cylindrical column so that its load bearing surface is upwardly oriented; a shock absorbing spring having an upper end and a lower end, the shock absorbing spring being mounted upon the pier so that its lower end is in contact with the load bearing surface of the slide stop; and a foundation supporting I-beam having an upper load bearing surface, a lower end, a forward end, and a rearward end, the rearward end of the foundation supporting I-beam being adapted for slidable mounting over the cylindrical column, the foundation supporting I-beam being slidably mounted over the cylindrical column so that its upper load bearing surface is upwardly oriented and so that its lower end is in contact with the upper end of the shock absorbing spring.

14 Claims, 4 Drawing Sheets

SEISMIC SHOCK ABSORBING PIER

FIELD OF THE INVENTION

The present invention relates to apparatus serving the dual purposes of supporting the concrete footing or foundation of a building and protecting the building from damaging effects of seismic shock waves traveling through the ground and through the apparatus.

BACKGROUND OF THE INVENTION

Building footing or foundation supporting devices such as are disclosed in U.S. Pat. No. 5,154,539 issued Oct. 13, 1992, to McCown, et al., serve the function of permanently raising and supporting the foundation of a building at a desired level. Such an apparatus typically comprises, as its major structural elements, a pier or pile driven or augured vertically downward into the ground, a foundation supporting bracket for engagement with the undersurface of the footing or foundation of a building, and a yoke serving the function of fixedly suspending the bracket from the upper end of the pier. Where such an apparatus is used in geographic areas prone to earthquakes and seismic tremors, seismic shock waves may be transmitted to the building directly through the pier, causing damage to the building at the point of contact between the building and the footing or foundation engaging bracket. The instant inventive seismic shock absorbing pier protects against such damage by modifying such foundation supporting piers to provide a shock absorbing means cushioning the mechanical load bearing linkage between the pier and the foundation of the building. The instant inventive seismic shock absorbing pier provides further protection against such damage by interposing at the point of contact between the foundation and the bracket a friction reducing sliding element such as nylon plastic, or a deformable energy absorbing element such as rubber.

PRIOR ART PATENTS

U.S. Pat. No. 5,154,539 issued Oct. 13, 1992, to McCown, Sr., et al., discloses a foundation lifting and stabilizing apparatus having no shock absorbing or friction reducing means.

U.S. Pat. No. 468,186 issued Feb. 2, 1992, to Beardsley discloses an electric light tower having a spring dampening means.

U.S. Pat. No. 4,716,696 issued Jan. 5, 1988, to Yacoboni discloses a resilient pier and footing apparatus.

U.S. Pat. No. 5,505,026 issued Apr. 9, 1996, to Fausto discloses a seismic shock absorbing load supporting structure for elevated constructions.

U.S. Pat. No. 5,509,238 issued Apr. 23, 1996, to Scalfati discloses a spring cushioned load supporting device.

U.S. Pat. No. 5,103,605 issued Apr. 14, 1992, to Sul discloses an earthquake resistant building supporting system.

None of the above disclosed patents teaches, describes or discloses the novel, inventive and unique aspects and features of the present invention.

SUMMARY OF THE INVENTION

The instant inventive seismic shock absorbing pier comprises a steel tubular cylindrical column, preferably having a circular lateral cross-sectional shape. Also preferably the cylindrical column comprises a series of joints threadedly attached to each other, end to end. At or near the edge of the foundation or footing of a building to be supported by the seismic shock absorbing pier, the cylindrical column is downwardly driven, preferably by means of an hydraulic ram, into the ground until its lower end firmly rests against bedrock. Alternately, an helical auger plate may be welded to the lower end of the cylindrical column, allowing the cylindrical column to be screwed into the ground through application of a rotational force, preferably supplied by a tractor mounted hydraulic motor. Rotation of the column, combined with downward pressure causes the auger plate to spin in a helical path downward into the ground.

The upper end of the cylindrical column is preferably covered by a load bearing disc, the load bearing disc having a diameter approximately equal to the outside diameter of the cylindrical column. A cap having a threadedly apertured ceiling is slidably mounted over the load bearing disc and over the upper end of the cylindrical column, and a threaded height adjustment bolt is threadedly mounted within and through the aperture so that the lower end of the threaded bolt is in contact with the upper surface of the load bearing disc. Manipulation of the bolt adjustably raises or lowers the cap to a desired elevation above the upper end of the column.

Fixedly welded to and extending outwardly and horizontally from opposing sides of the exterior sidewall of the cap are paired wings. Fixedly welded to the distal end of each wing is a suspension bar, each suspension bar extending perpendicularly downward. Preferably, the lengths of the wings welded to the cap and the lengths of the suspension bars welded to the wings define a space, centered about the cylindrical column, large enough to contain a foundation supporting bracket and a seismic shock absorbing spring.

A winged cylindrical sleeve is slidably mounted over the cylindrical column below the winged cap, and at a level even with the lower ends of the suspension bars. Like the winged cap, the winged cylindrical sleeve has opposing wings welded thereto, the distal end of each such wing having a pin receiving aperture. The lower ends of the suspension bars similarly have pin receiving apertures, so that the lower ends of the suspension bars may be fixedly attached to the distal ends of the wings. Such attachment is preferably accomplished by means of shear pins passing through such apertures. The upper surfaces of the winged cylindrical sleeve are load bearing.

A first load bearing ring is slidably mounted over the cylindrical column so that its lower surface is in contact with the upper load bearing surface of the winged cylindrical sleeve. A heavy gauge helical compression spring is slidably mounted over the cylindrical column so that its lower end is in contact with the upper surface of the first load bearing ring. A second load bearing ring is slidably mounted over the cylindrical column so that its lower surface is in contact with the upper end of the helical spring. A second cylindrical sleeve is slidably mounted over the cylindrical column so that its lower end is in contact with the upper surface of the second load bearing ring, and so that its upper end lies below the lower end of the winged cap. A short section of steel I-beam, approximately one foot to one and one-half feet long is welded to the exterior sidewall of the second cylindrical sleeve, the I-beam being positioned so that its central span is substantially vertical and so that one of its flanges forms a horizontal load bearing surface.

In operation, downward pressure from the footing or foundation of a building is transferred through the upper load bearing surface of the I-beam, thence to the second cylindrical sleeve, thence to the second load bearing ring, thence through the helical compression spring, thence to the first load bearing ring, thence to the winged cylindrical sleeve, thence to the vertically oriented suspension bars, thence to the winged cap, thence to the threaded adjustment bolt, thence to the load bearing disc, and thence to the upper surface of the cylindrical column. Seismic shock waves traveling upward through the earth, and through the cylindrical column, necessarily pass through the helical compression spring prior to reaching the load bearing surface of the I-beam. The spring lengthens the time of transmission of energy from each shock wave, decreasing the tendency of the shock waves to cause damage to the building.

In order to mitigate damage which may be caused by lateral seismic movements and vibrations transmitted through the cylindrical column, a slide plate and a downwardly opening C-channel are disposed between the upper bearing surface of the I-beam and the lower surface of the footing or foundation of the building. Preferably, the slide plate is composed of nylon plastic allowing the I-beam to slip limited distances in a horizontal plane beneath the footing without damaging the building. Alternately, a section of a deformable elastomer such as rubber may be disposed between the interior surface of the channel and the upper surface of the I-beam, dampening horizontal vibrations, providing further damage prevention.

In operation, the tension or compression force upon the spring may be adjusted by turning the adjustment bolt extending through the ceiling of the cap. By turning the adjustment bolt clockwise, the cap is raised to a higher elevation above the upper end of the cylindrical column, causing the winged cylindrical sleeve to move upward. Such motion compresses the spring, applying a greater upward force to the footing of the building. In order to decrease pressure upon the spring and upon the footing of the building, the adjustment bolt may be turned counter-clockwise.

Accordingly, it is an object of the provide inventive seismic shock absorbing pier including a column for providing support to the footing or foundation of a building while also providing a seismic shock dampening or absorbing means, lessening and mitigating the destructive force of seismic shock waves traveling through the pier.

It is a further object of the present invention to provide such a pier, wherein the shock absorbing means is a heavy gauge compression spring.

It is a further object to provide such a shock absorbing pier, wherein the compression of the spring is adjustable through turning of a threaded adjustment bolt.

It is a further object to provide such a shock absorbing pier further providing a sliding means or a means of elastic deformation protecting the footing of a building from lateral or horizontal seismic vibrations.

Other and further objects, benefits, and advantages of the present invention will become apparent to those skilled in the art upon review of the Detailed Description which follows and upon review of the appended drawings.

DETAILED DESCRIPTION OF THE PREFERRED EMBODIMENT

Figure 1:
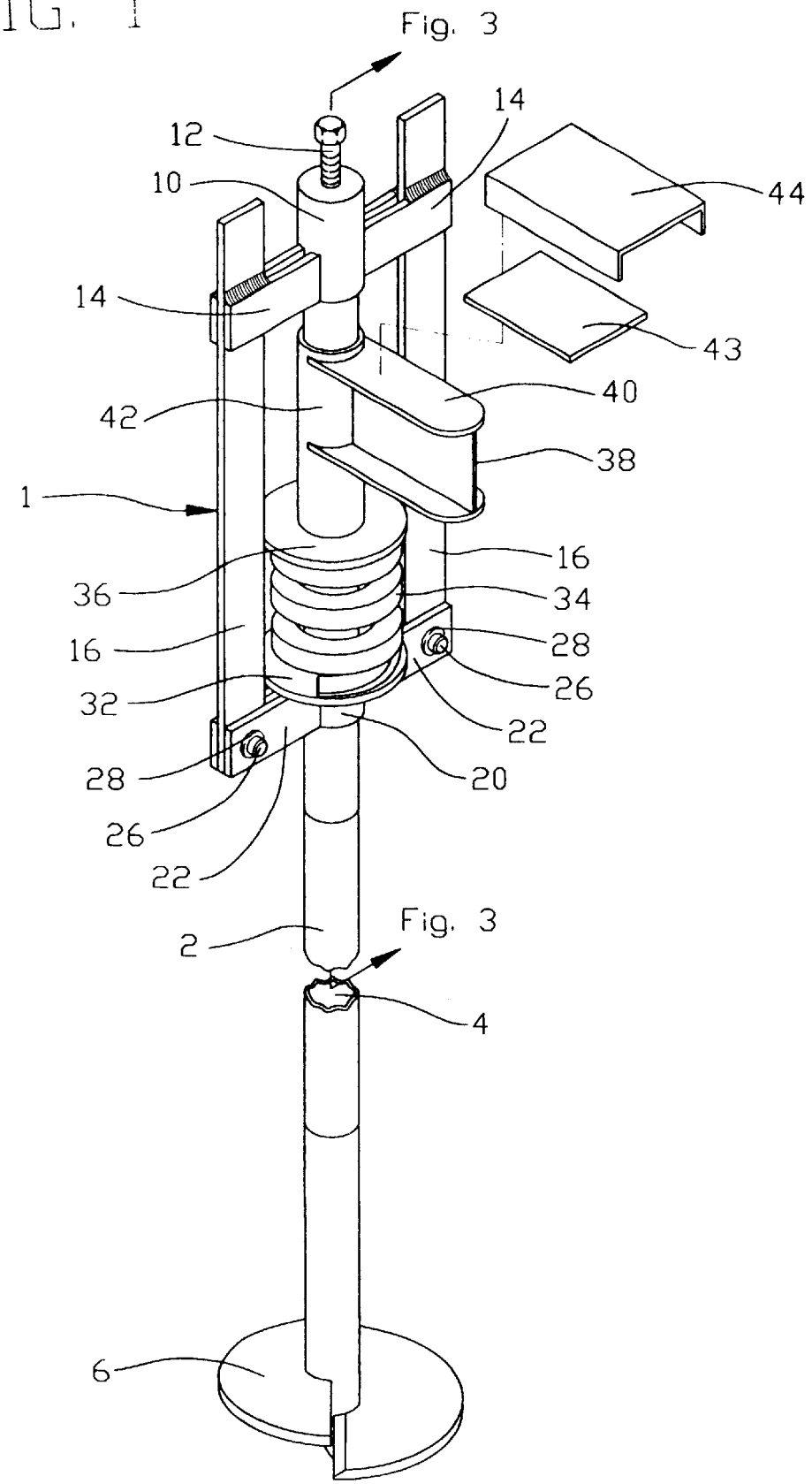
FIG. 1 is an isometric view of the seismic shock absorbing pier.
Figure 4:
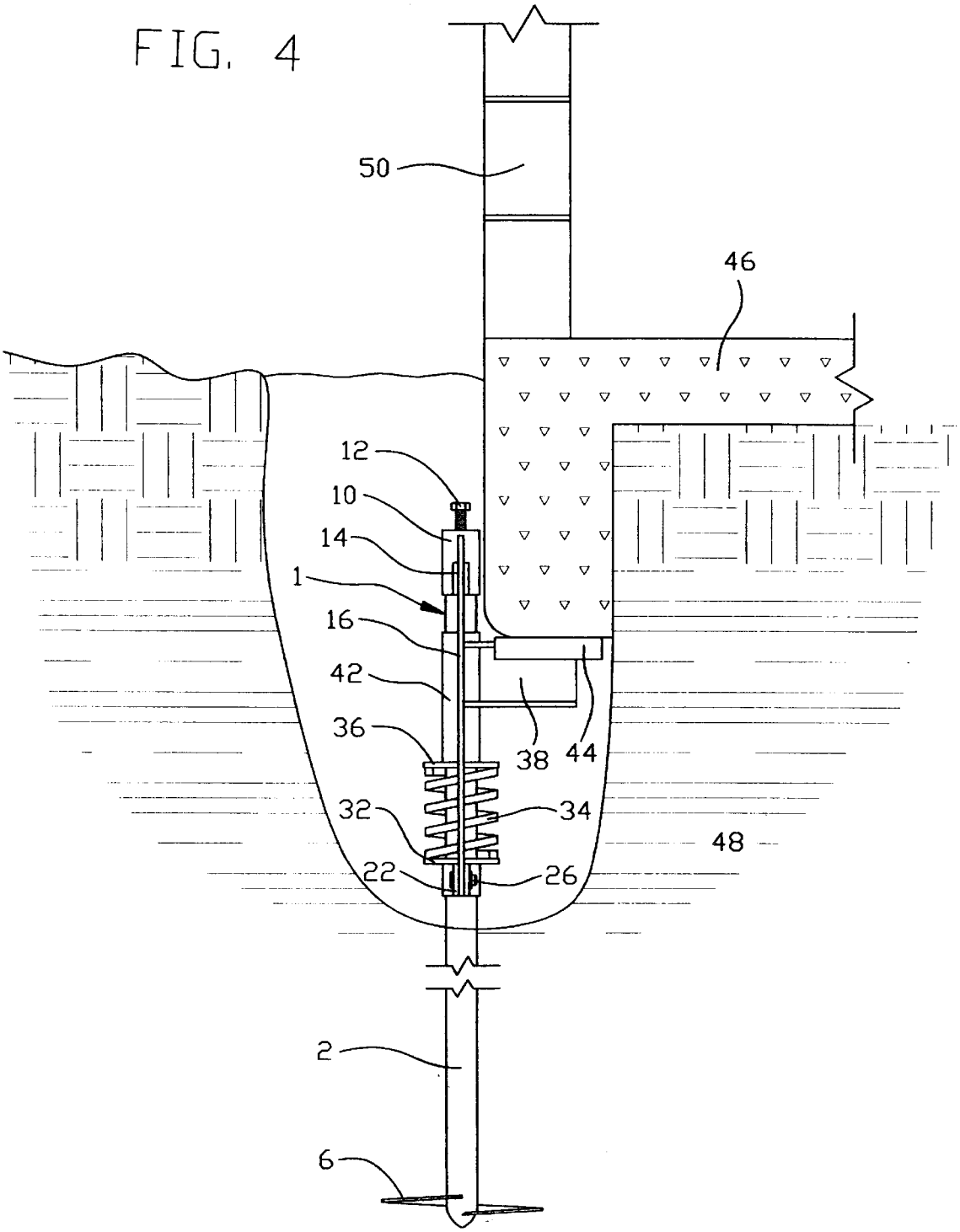
FIG. 4 is a sideview of the seismic shock absorbing pier shown installed supporting the footing of a building.

Referring now to the drawings, and in particular to FIG. 1, the seismic shock absorbing pier is referred to generally by drawing element 1. The major structural element of the seismic shock absorbing pier 1 is a segmented cylindrical steel column 2, preferably having an hollow interior bore 4. Preferably, the segments of the segmented column 2 are joined together by interlocking spiral threads. Referring to FIG. 4, welded at the base of the segmented column 2 is a helical auger plate 6 for driving the segmented column 2 vertically downward into the ground 48 in spiral fashion. Alternately, the lower end of the segmented column 2, having no helical auger plate 6, may be driven by means of an hydraulic ram downward into the ground 48 until the lower end securely rests against bedrock. The helical auger plate 6, or the lower end of the segmented column 2 resting against bedrock, provides a firm foundation supporting the upper end of the segmented column 2, and for supporting a building 50 having a concrete footing or foundation 46.

Figure 2:
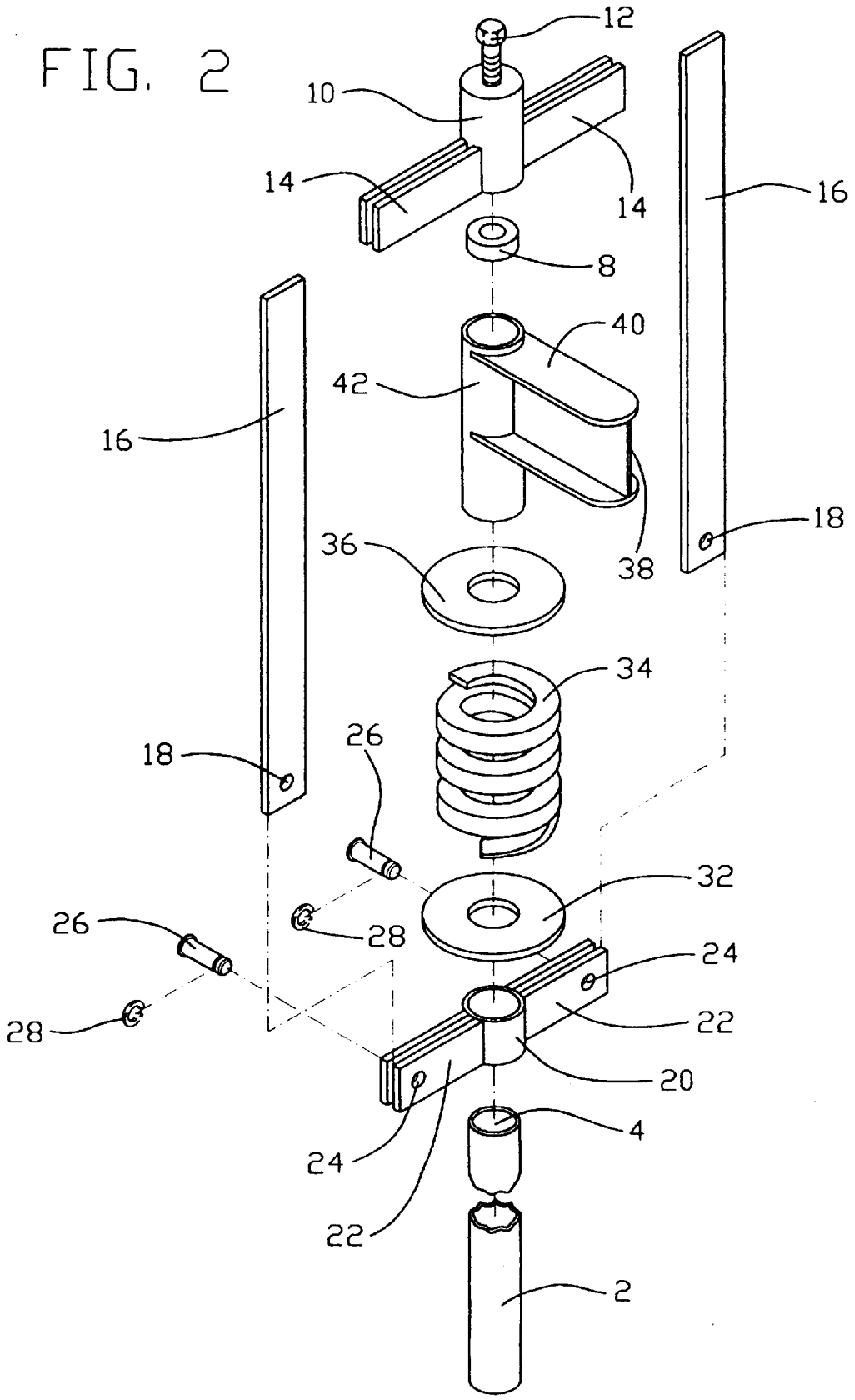
FIG. 2 is an exploded isometric view of the seismic shock absorbing pier.
Figure 3:
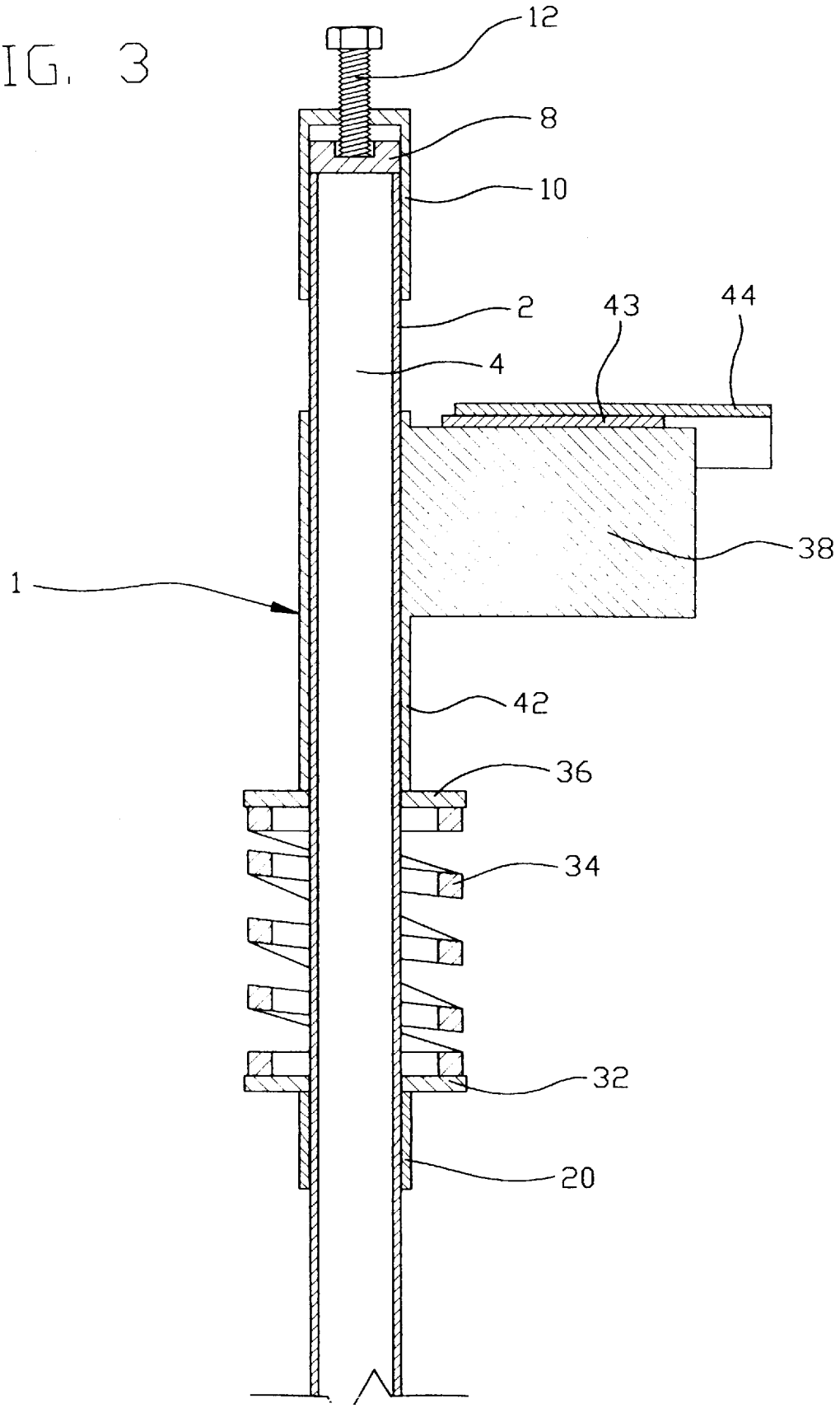
FIG. 3 is a sectional sideview of the seismic shock absorbing pier.

Referring simultaneously to FIGS. 2 and 3, a steel load bearing disc 8 rests upon the upper end of the segmented column 2. Referring simultaneously to FIGS. 1 and 3, a winged cap 10 is slidably mounted over the upper end of the segmented column 2 and over the load bearing disc 8. The upper ceiling of the winged cap 10 has a threaded aperture through which is threadedly mounted a threaded adjustment bolt 12. By selectively rotating the threaded adjustment bolt 12 clockwise or counter-clockwise, the elevation of the winged cap 10 in relation to the upper end of the segmented column 2 may be adjusted to a desired level.

Referring to FIG. 1, paired wings 14 preferably composed of steel are welded to the exterior sidewall of the winged cap 10 so that the paired wings 14 extend outwardly in opposite directions. A pair of suspension bars 16 are fixedly welded to the distal ends of the paired wings 14, the suspension bars 16 being positioned between the paired wings 14. The elevation of the lower ends of the suspension bars 16 are adjusted by selectively welding such bars to the distal ends of the paired wings 14 at a desired location near the upper end of such bars. Referring to FIG. 2, the lower end of each suspension bar 16 has a pin receiving aperture 18.

Referring simultaneously to FIGS. 2 and 3, a winged sleeve 20 is slidably mounted over the segmented column 2; the winged sleeve 20, like the winged cap 10, having paired wings 22 extending outwardly therefrom, the distal ends of the paired wings 22 having pin receiving apertures 24. Referring simultaneously to FIGS. 1 and 2, the suspension bars 16 are fixedly attached to the paired wings 22 of the winged sleeve 20 by means of pins 26 which pass through the pin receiving apertures 18 of the suspension bars 16, and through the pin receiving apertures 24 of the paired wings 22, each pin 26 being secured in place by a pressure ring 28 which rests within a pressure ring channel 30.

Referring simultaneously to FIGS. 2 and 3, a lower load bearing ring 32 is slidably mounted over the segmented column 2 so that its lower surface rests in contact upon the upper surfaces of the winged sleeve 20 and the paired wings 22. A heavy gauge helical compression spring 34 is slidably mounted over the segmented column 2 so that its lower end rests in contact upon the upper surface of the lower bearing ring 32. An upper load bearing ring 36 is slidably mounted over the segmented column 2 so that its lower surface rests in contact upon the upper end of the helical compression ring 34.

Referring simultaneously to FIGS. 1 and 2, a section of I-beam 38 approximately one foot to one and one-half feet long, having an upper load bearing surface 40 is welded to a cylindrical sleeve 42 so that the upper load bearing surface 40 is substantially horizontal. The cylindrical sleeve 42 is slidably mounted over the segmented column 2 so that its lower end rests in contact upon the upper surface of the upper bearing ring 36.

Referring to FIG. 1, forces directed downward upon the upper load bearing surface 40 of the I-beam 38 are transferred to the cylindrical sleeve 42, thence to the upper load bearing ring 36, thence to the helical compression spring 34, thence to the lower load bearing ring 32, thence to the winged sleeve 20 and to the paired wings 22, thence to the suspension bars 16, thence to the paired wings 14 and the winged cap 10. Referring to FIG. 3, such downward force is then transferred in sequence to the threaded adjustment bolt 12, thence to the load bearing disc 8, and thence to the upper end of the segmented column 2. Referring to FIG. 1, forces directed upward through the segmented column 2 are transferred to the upper load bearing surface 40 of the I-beam 38 in a reverse path.

Referring to FIG. 4, according to the above described mechanical sequence, counter-acting forces between the footing or foundation 46 of the building 50 resting against the upper load bearing surface of the I-beam 38 and the segmented column 2 necessarily pass through the helical compression spring 34, allowing such spring to lengthen the energy transfer time of vibrations passing through the mechanical linkage. Such lengthening of energy transfer time reduces the damaging effect of seismic shock waves traveling through the ground, and upwardly through the segmented column 2.

Referring simultaneously to FIGS. 1 and 4, a slide plate 43, preferably composed of highly durable nylon plastic may be caused to rest against the upper load bearing surface 40 of the I-beam 38. When such a slide plate 43 is utilized, a length of "C" channel iron 44 rests over the slide plate 43, the distance between the interior walls of the "C" channel iron 44 being approximately one inch wider than the width of the slide plate 42. The slide plate 43 and the "C" channel iron 44 are disposed between the I-beam 38 and the lower surface of the building footing or foundation 46. The use of the seismic shock absorbing pier in combination with the slide plate 43 and the "C" channel iron 44 protects the building 50 supported by the seismic shock absorbing pier 1 from the lateral or horizontal force components of seismic vibrations. The coefficients of friction between the metal surfaces of the I-beam 38 and the "C" channel iron 44 are less than the coefficient of friction between the upper surface of the "C" channel iron 44 and, referring to FIG. 4, the undersurface of the footing 46 of the building 50. By introducing a zone of relatively low friction between the seismic shock absorbing pier 1 and the footing 46, the risk of damage caused by lateral or horizontal seismic movements is lessened. Alternately plate 43 may comprise a deformable elastomere such as rubber, such plate serving the function of dampening such horizontal movements, thereby preventing damage to the building 50.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A seismic shock absorbing pier comprising:

(a) a column having an upper end and a lower end;

(b) a slide stop having a load bearing surface, the slide stop being fixedly attached to the column so that its load bearing surface is upwardly oriented;

(c) a shock absorbing means having an upper end and a lower end, the shock absorbing means being mounted upon the seismic shock absorbing pier so that the lower end of the shock absorbing means is in contact with the load bearing surface of the slide stop; and, (d) a foundation supporting means having an upper load bearing surface, a lower end, a forward end, and a rearward end, the rearward end of the foundation supporting means having an adaptation making the foundation supporting means capable of being slidably mounted over the column, the foundation supporting means being thereby slidably mounted over the column so that its upper load bearing surface is upwardly oriented and so that its lower end is in contact with the upper end of the shock absorbing means.

2. The seismic shock absorbing pier of claim No. 1, wherein the load bearing surface of the slide stop comprises the upper surface of a winged sleeve slidably mounted over the column; and wherein the slide stop further comprises a winged cap fixedly mounted over the upper end of the column, and a plurality of suspension bars fixedly attached to and spanning substantially vertically between the wings of the winged cap and the wings of the winged sleeve.

3. The seismic shock absorbing pier of claim No. 2, wherein the column is tubular, having a circular lateral cross-sectional shape, and wherein the winged cap comprises a ceiling, the ceiling having an upper surface and a lower surface and having a threaded aperture extending from its upper surface to its lower surface; and further comprising a slide stop adjustment screw having an upper end and a lower end, the slide stop adjustment screw being threadedly mounted within the threaded aperture so that its lower end downwardly extends below the lower surface of the ceiling; and further comprising a load bearing disc having an upper end and a lower end, the load bearing disc being fitted for positioning and being positioned upon the seismic shock absorbing pier so that its lower end is in contact with the upper end of the column, and so that its upper end is in contact with the lower end of the slide stop adjustment screw.

4. The seismic shock absorbing pier of claim No. 3, wherein the shock absorbing means comprises a first load bearing ring having an upper surface and a lower surface, the first load bearing ring being slidably mounted over the column so that its lower surface is in contact with the load bearing surface of the slide stop; a helical spring having an upper end and a lower end, the helical spring being mounted over the column so that its lower end is in contact with the upper surface of the first load bearing ring; and comprising a second load bearing ring having an upper surface and a lower surface, the second load bearing ring being mounted over the column so that its lower surface is in contact with the upper end of the helical spring and so that its upper surface is in contact with the lower end of the foundation supporting means.

5. The seismic shock absorbing pier of claim No. 4, wherein the adaptation of the rearward end of the foundation supporting means comprises a cylindrical sleeve fitted for slidable mounting over the column, and wherein the upper load bearing surface of the foundation supporting means extends substantially perpendicularly from the exterior sidewall of the cylindrical sleeve.

6. The seismic shock absorbing pier of claim No. 5, wherein the fixed attachments of the wings of the winged cap to the suspension bars comprise heat fusion welds, and wherein the fixed attachments of the wings of the winged sleeve to the suspension bars comprise pin and eye joints.

7. The seismic shock absorbing pier of claim No. 6, wherein the upper load bearing surface of the foundation supporting means comprises the upper surface of a beam fixedly attached to and extending substantially perpendicularly from the exterior sidewall of the cylindrical sleeve.

8. The seismic shock absorbing pier of claim No. 7, further comprising an helical auger plate fixedly attached to the lower end of the cylindrical column.

9. The seismic shock absorbing pier of claim No. 8, further comprising a slide plate having an upper surface and a lower surface, the lower surface of the slide plate being in slidable contact with the upper surface of the beam.

10. The seismic shock absorbing pier of claim No. 9, further comprising a downwardly opening "C" channel plate, the floor of the channel of the "C" channel plate being in slidable contact with the upper surface of the slide plate.

11. The seismic shock absorbing pier of claim No. 8, further comprising an elastomeric cushion having an upper surface and a lower surface, the lower surface of the elastomeric cushion being in contact with the upper surface of the beam.

12. The seismic shock absorbing pier of claim No. 11, further comprising a downwardly opening "C" channel plate, the floor of the channel of the "C" channel plate being in contact with the upper surface of the elastomeric cushion.

13. The seismic shock absorbing pier of claim No. 1, wherein the shock absorbing means comprises a first load bearing ring having an upper surface and a lower surface, the first load bearing ring being slidably mounted over the column so that its lower surface is in contact with the load bearing surface of the slide stop; a helical spring having an upper end and a lower end, the helical spring being mounted over the column so that its lower end is in contact with the upper surface of the first load bearing ring; and comprising a second load bearing ring having an upper surface and a lower surface, the second load bearing ring being mounted over the column so that its lower surface is in contact with the upper end of the helical spring and so that its upper surface is in contact with the lower end of the foundation supporting means.

14. The seismic shock absorbing pier of claim No. 1, wherein the adaptation of the rearward end of the foundation supporting means comprises a cylindrical sleeve fitted for slidable mounting over the column, and wherein the upper load bearing surface of the foundation supporting means extends substantially perpendicularly from the exterior sidewall of the cylindrical sleeve.

* * * * *